US007045733B2

(12) United States Patent
Bresciani et al.

(10) Patent No.: US 7,045,733 B2
(45) Date of Patent: May 16, 2006

(54) LOW-VOLTAGE CIRCUIT-BREAKER AND CORRESPONDING POSITIVE-OPENING-OPERATION DEVICE

(75) Inventors: Nicola Bresciani, Bergamo (IT); Roberto Rota Martir, Brembate Sopra (IT)

(73) Assignee: ABB Service S.r.l., (IT)

( * ) Notice: Subject to any disclaimer, the term of this patent is extended or adjusted under 35 U.S.C. 154(b) by 153 days.

(21) Appl. No.: 10/791,732

(22) Filed: Mar. 4, 2004

(65) Prior Publication Data

US 2004/0173577 A1 Sep. 9, 2004

(30) Foreign Application Priority Data

Mar. 7, 2003 (IT) ..... BG2003A0018

(51) Int. Cl.
*H01H 5/00* (2006.01)

(52) U.S. Cl. ..... 200/400; 200/401; 218/154; 335/167; 335/172

(58) Field of Classification Search ..... 200/400, 200/401; 218/154; 335/167, 172, 174, 21–24, 335/173

See application file for complete search history.

(56) References Cited

U.S. PATENT DOCUMENTS 3,921,109 A * 11/1975 Hodgson ..... 335/195
5,250,918 A 10/1993 Edds et al.
5,260,533 A 11/1993 Livesey et al.
6,316,742 B1 * 11/2001 Rostron et al. ..... 218/84

* cited by examiner

*Primary Examiner*—K Lee
(74) *Attorney, Agent, or Firm*—Connolly, Bove, Lodge & Hutz LLP

(57) ABSTRACT

Described herein is a low-voltage circuit-breaker, which comprises at least one mobile contact and a corresponding fixed contact, and a positive-opening-operation device. The positive-opening-operation device in turn comprises: a moving element associated to the mobile contact; a first kinematic chain, operatively associated to said mobile contact and to an actuating device; and a second kinematic chain, associated to said moving element and to said first kinematic chain. A first lever is associated to the first kinematic chain and a second lever is associated to the second kinematic chain, said first and second levers interacting with one another during the opening operation and being equipped with blocking devices in the event of welding of the contacts together.

15 Claims, 4 Drawing Sheets

LOW-VOLTAGE CIRCUIT-BREAKER AND CORRESPONDING POSITIVE-OPENING-OPERATION DEVICE

The present invention relates to a low-voltage unipolar or multipolar automatic circuit-breaker and in particular to a low-voltage circuit-breaker equipped with a corresponding positive-opening-operation device.

In industrial low-voltage electrical wiring systems characterized by high currents and high powers, specific devices, commonly referred to as automatic power circuit-breakers, are normally used.

Said circuit-breakers are devised so as to provide a series of performance features necessary for guaranteeing correct operation of the electrical wiring system in which they are inserted, and of the loads connected thereto. For example, they ensure the rated current required for the different loads, enable proper connection and disconnection of the loads to/from the circuit, protect the loads from anomalous events, such as overloading and short circuits, via automatic opening of the circuit, enable disconnection of the circuit via galvanic separation or circuit opening by purposely provided contacts, thus leading to total isolation of the load with respect to the electric power source.

For the aforesaid devices there exist a wide range of industrial solutions. The most common solution entrusts closing and opening of the contacts to mechanical means, said control members, actuated by the mechanical energy accumulated in specially provided springs (typically the so-called energy-accumulation springs and springs of the moving element). In principle, the greater the amount of energy accumulated in said springs, the higher the speed reached by the contacts both during closing and during opening. Above all in the opening phase, the higher said speed is, the lower the thermal energy that tends to develop as a result of interruptions of the arc, which are notoriously harmful for the apparatus. Hence, in the final analysis, the higher said speed is, the more favourable the conditions in which the apparatus operates, with evident benefits in terms of duration and general efficiency of said apparatus.

An automatic circuit-breaker normally comprises also a safety device designed to provide the so-called "positive-opening operation", which consists in ensuring that all of the main contacts will be in an opening position when the control lever of the circuit-breaker is in the position marked indifferently as "OPEN", or "OFF", or "0". The positive-opening-operation device guarantees, among other things, that should the contacts remain welded together on account of a short circuit of high intensity, it will be impossible to bring the control lever of the circuit-breaker into a position of "OPEN"/"OFF"/"0".

When an automatic circuit-breaker of a known type is in a closing position, the energy-accumulation springs withhold the control lever in the position of "CLOSED"/"ON"/"I", so preventing any accidental opening, whilst the springs of the moving element withhold the mobile contacts of the circuit-breaker sufficiently compressed against the corresponding fixed contacts, so guaranteeing optimal conductivity.

To enable an opening operation to be performed successfully in an automatic circuit-breaker it is thus necessary to apply to the control lever an amount of energy sufficient for overcoming the friction and the antagonistic force exerted by the energy-accumulation springs, which are consequently progressively lengthened.

By analysing the entire course of the opening operation, it is possible to recognize technically three substantially distinct phases. Said phases are: a first phase, in which there is an increase in loading of the energy-accumulation springs; a second phase, in which the so-called dead point is exceeded; and a third phase, in which there occurs transfer of the potential energy available at that moment in the energy-accumulation springs and in the springs of the moving element, said release of energy being directed to the kinematic chain that terminates with the mobile contacts. This third phase is the one actually associated to opening of the contacts.

It is necessary, at to this point, to note that the increase in lengthening impressed on the energy-accumulation springs in the initial phase of the opening operation is substantially fixed and pre-determined, being linked only to the parameters that characterize the springs and to the geometry of the kinematic mechanism. Since the potential energy that may be accumulated in said springs is in turn correlated to said pre-determined lengthening, also the energy that said springs can restore is to be considered substantially invariable. For similar reasons, since the energy accumulated in the springs of the moving element is also pre-determined, the total energy available for bringing about opening of the contacts is in the final analysis also substantially invariable.

It may be noted, moreover, that a possible excess in the energy applied by the operator or by some other servo system to the opening lever (typically a control solenoid) is dissipated and not exploited in any way for favouring opening. Said excess of energy, which may even be quite considerable, in circuit-breakers of a known type finds passive dissipation in the impact of the lever or of other mechanical parts against the retention devices.

In circuit-breakers of a known type, in the case where an opening operation is performed by operating the control lever, in the proximity of the so-called dead point that corresponds substantially to the maximum loading of the energy-accumulation springs, the control members do not receive any other energy than the potential energy available in the energy-accumulation springs and in the springs of the moving element. As already mentioned, said energy has a value that is substantially fixed and pre-determined. In circuit-breakers of a known type, this is hence the only energy transferred to the control members that contributes to the acceleration and separation of the mobile contacts from the fixed contacts. There is thus no benefit drawn in any way from the possible excess of energy applied to the control lever at the moment of the opening operation.

A primary task of the present invention is to provide a low-voltage circuit-breaker that will enable the drawbacks described above to be overcome and, in particular, that is equipped with a contact-opening device that will enable acceleration of the contact-opening operation.

Within the context of this task, one of the purposes of the present invention is to integrate in said contact-opening device, a positive-opening-operation device that will guarantee the peculiarities described above and that can be made with a minimum number of mechanical elements.

Yet another purpose of the present invention is to provide a low-voltage circuit-breaker that is equipped with a positive-opening-operation device that will enable recovery of the possible excess of energy supplied by the operator or by some other automatic system in the circuit-opening phase.

Not the least important purpose of the present invention is to provide a low-voltage circuit-breaker and corresponding positive-opening-operation device that will present high reliability, relative ease of construction and competitive costs.

The above task and the above purposes, as well as others that will appear more evidently from the ensuing description are achieved by a low-voltage circuit-breaker that comprises at least one mobile contact, which can be coupled to/uncoupled from a corresponding fixed contact, and a positive-opening-operation device. The circuit-breaker according to the invention is characterized in that said positive-opening-operation device comprises: a moving element associated to the mobile contact; a first kinematic chain operatively associated to said mobile contact and to an actuating device; and a second kinematic chain associated to said moving element and to said first kinematic chain. In the circuit-breaker according to the invention, a first lever is associated to the first kinematic chain and a second lever is associated to the second kinematic chain, said first and second levers interacting with one another during the opening operation and being equipped with blocking devices in the event of welding of the contacts together.

Preferably, said positive-opening-operation device comprises a first spring associated to said moving element and a second spring associated to said first and second kinematic chains.

Advantageously, in the circuit-breaker according to the invention, an operation of contact opening as a result of a force applied on said actuating device comprises: a first phase, in which the first kinematic chain moves as a result of said force applied on said actuating device, storing energy in said second spring, the second kinematic chain remaining substantially stationary during this first phase; and a second phase, in which the second kinematic chain moves as a result of the release of energy stored in said first spring and/or said second spring and/or as a result of the interaction between said first and second levers.

The positive-opening operation proves advantageous in that, in said second phase and in the event of welding of the contacts together, the movement during opening of said first kinematic chain is blocked by said devices for blocking said first and second levers. The recovery of energy and the acceleration of the opening operation can to advantage be achieved, for example, via a configuration of the mechanism, in which said first lever transfers to said second lever at least part of the kinetic energy $E_k$ possessed by the first kinematic chain in the opening stage, and in which said second lever transfers to said moving element, through the second kinematic chain, at least part of the kinetic energy $E_k$ received from said first kinematic chain.

Preferably, in the circuit-breaker according to the invention, the moving element comprises: a contact-bearing shaft, which rotates about its own axis and from which there projects at least one mobile contact; and at least one first spring, which acts on said contact-bearing shaft and on said mobile contact.

The first kinematic chain may, for example, comprise: a first hinge, a third control lever pivoted on said first hinge and operatively connected to said actuating device; and a second spring constrained to said third control lever and operatively connected to said second kinematic chain, the first lever being fixed to said third control lever.

In turn, the second kinematic chain may comprise, for example, a second hinge, a first crank, a first connecting rod, and a first fork, the first crank being pivoted on said second hinge, and the first connecting rod having a first end pivoted on said contact-bearing shaft, said second spring and a first end of said first fork being operatively connected to said first connecting rod, a point of said first fork being pivoted on said first crank, the second lever projecting from said first fork.

In the circuit-breaker according to the invention, the operation of opening the contacts as a result of a force applied on said actuating device may conveniently comprise: a first phase, in which said third lever rotates about said first hinge, storing energy in said second spring, the second kinematic pair remaining substantially stationary; and a second phase, in which said third lever continues to rotate about said first hinge, transferring, via an interaction between said first and second lever, at least part of the kinetic energy $E_k$ to said second kinematic chain.

In turn, the second phase may to advantage comprise: a first step, in which the contact-bearing shaft rotates about its own axis as a result of the action of said second spring via the first connecting rod, as a result of the action of said first spring and as a result of the action of the first lever through the second lever and the first fork, the mobile contact remaining substantially stationary during this first step; and a second step, in which the contact-bearing shaft continues to rotate about its own axis, drawing along with it said mobile contact and bringing about opening of the circuit.

Advantageously, in the event of welding of the contacts together, at the end of said first step of said second phase the rotation of the third lever about said first hinge is prevented by said devices for blocking said first and second levers.

In this way, thanks to the innovative idea of the invention, the low-voltage circuit-breaker and the corresponding positive-opening-operation device according to the invention, renders possible acceleration of the opening operation via recovery, either partial or total, of the possible kinetic energy in excess supplied to the actuating device. At the same time the mechanism proves enormously simplified in that the positive-opening-operation device is integrated in the opening mechanism itself.

Further characteristics and advantages will emerge more clearly from the description of preferred, but non-exclusive, embodiments of a low-voltage circuit-breaker and of the corresponding positive-opening-operation device, according to the invention, illustrated by way of indicative and non-limiting example, with the aid of the attached drawings, in which.

Figure 1:
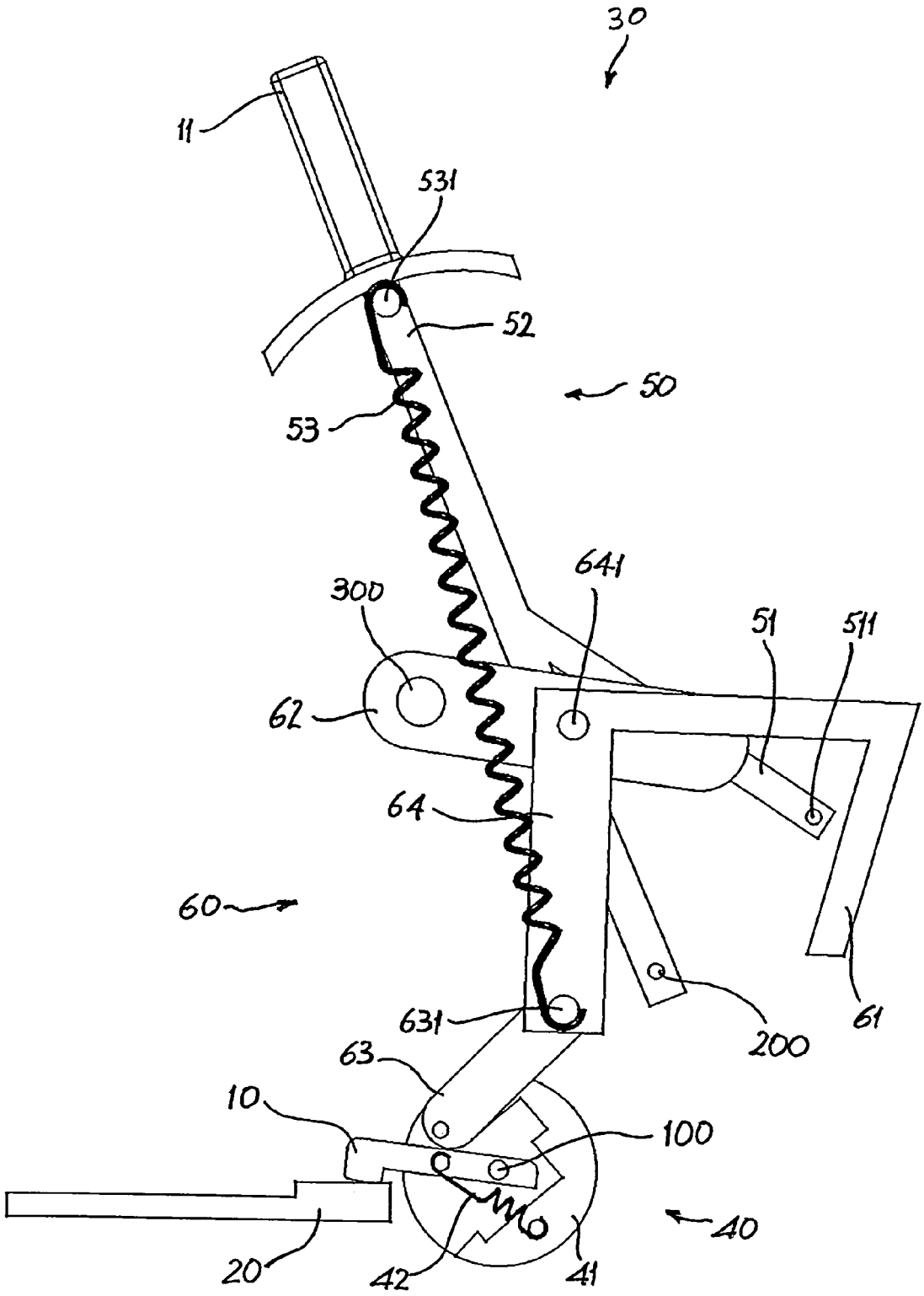
FIG. 1 is a schematic representation of a first embodiment of the circuit-breaker according to the invention, illustrated in a circuit-closing position.

In the following description, for reasons of greater simplicity, reference will be made to a particular embodiment, without this implying any limitation of the scope of the invention, since the solution is devised also with alternative kinematic mechanisms falling within the scope of the invention.

With reference to the annexed figures, the circuit-breaker according to the invention comprises at least one mobile contact 10, which can be coupled to or uncoupled from a corresponding fixed contact 20, which is electrically connected to a connection terminal with an electrical circuit. The circuit-breaker moreover comprises: a positive-opening-operation device 30, comprising a moving element 40; a first kinematic chain 50; and a second kinematic chain 60. The opening device is operated by an actuating device 11, which can be either of a manual type (for example, obtained just with the knob illustrated in the figures) or of an automatic type (for example, by adding a solenoid control).

The moving element 40 preferably comprises a contact-bearing shaft 41, rotating about its own axis 100, which houses within it a part of the mobile contact 10. At least one spring 42, which acts on the contact-bearing shaft 41 and on the mobile contact 10, is preferably present in order to guarantee an adequate force of contact on the surfaces of interface between the mobile contact and the fixed contact. It is obviously possible to use also a number of springs 42, as well as systems with a number of mobile contacts per phase, such as for instance the so-called double-interruption systems.

The first kinematic chain comprises, for example, a third control lever 52, operatively connected to the actuating device 11 and pivoted on a first hinge 200. A second spring 53, for accumulation of energy, is constrained to the lever 52 and is operatively connected to the second kinematic chain 60, as described in what follows. Obviously, it is also possible to use a number of energy-accumulation springs. A first lever 51 for release of the energy is fixed to the control lever 52, for example in its intermediate point. Preferably, the first lever 51 has, at its free end, energy-transfer and blocking means 511, constituted for example by a pin.

The second kinematic chain 60 may, for instance, comprise a second hinge 300, a first crank 62, a first connecting rod 63, and a first fork 64. The first crank 62 is conveniently pivoted on said second hinge 300. The first connecting rod 63 has a first end pivoted on said contact-bearing shaft 41. The second spring 53 and a first end of the first fork 64 are operatively connected to said connecting rod 63, for example at its second end. The first fork 64 is conveniently pivoted on said first crank 62. Finally, a second lever 61 for recovery of the energy projects from said first fork 64, for example at its second end.

There will now be described, with reference to the annexed figures, the operation of the circuit-breaker according to the invention, concentrating in particular on the characteristic functionalities of the subject of the invention and without describing the functions corresponding to the normal means of control of known circuit-breakers. In the embodiment illustrated in the attached figures, the points 100, 200, 300 are substantially fixed with respect to the structure of the control members or of the circuit-breaker itself and are hence not subject to any relative movement.

With reference to FIG. 1, a circuit-breaker according to the invention is represented in the closing position. In this position, the mobile contact 10 is subject to the force of the spring 42, which guarantees an adequate pressure on the contact surfaces.

Figure 2:
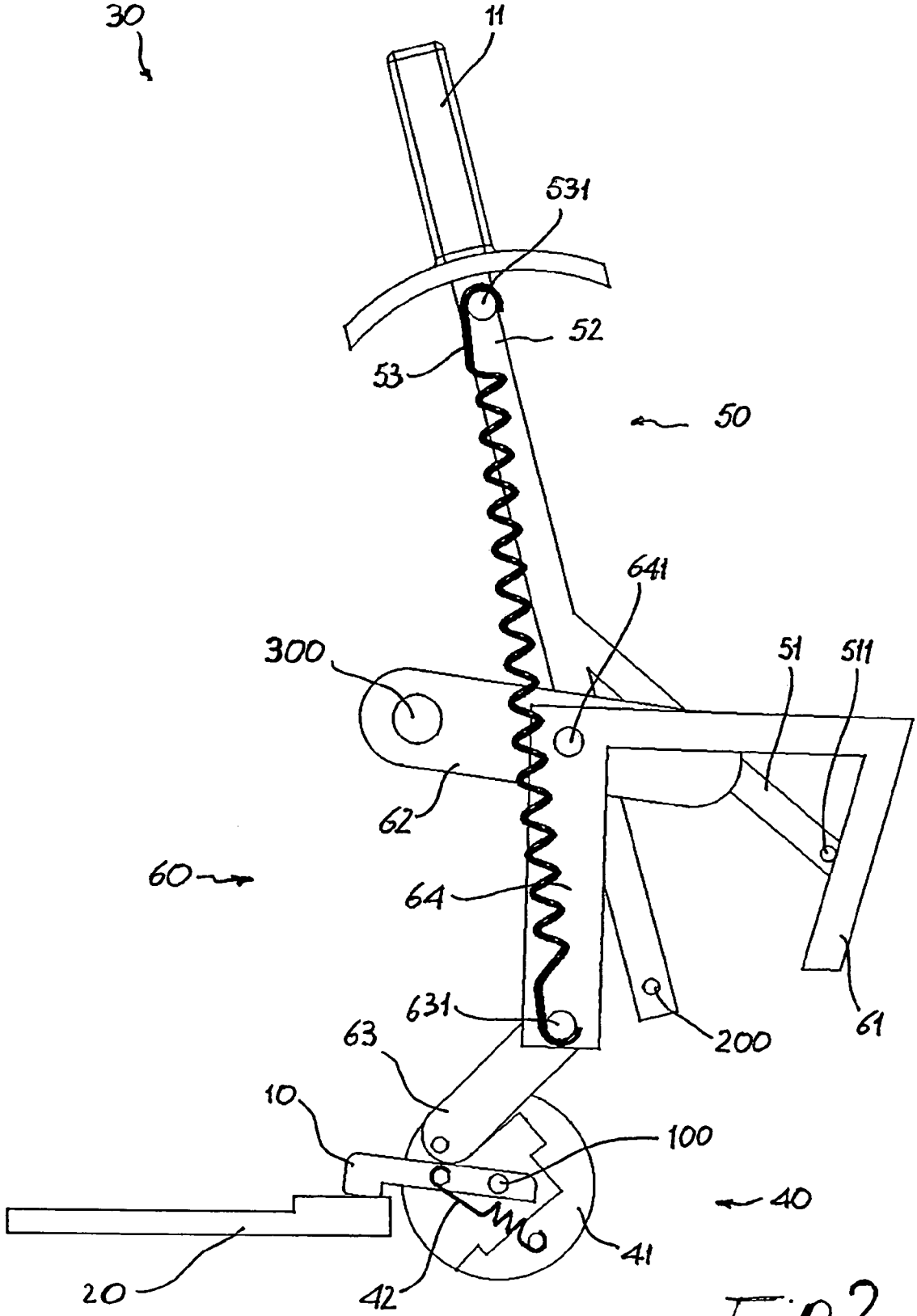
FIG. 2 is a schematic representation of the circuit-breaker of FIG. 1, illustrated during a first phase of the opening operation.

During the first phase of the opening operation (see FIG. 2), an amount of mechanical energy that must be at least sufficient to complete the operation is impressed on the lever 52 via an actuating device constituted, for example, by the knob 11, possibly with the aid of mechanical servo means. Said action causes rotation (in a clockwise direction, as viewed in the attached figures) of the lever 52 about its own axis of rotation 200, and impresses on the spring 53 an increase in elongation that results in an increase in the potential energy accumulated therein. At the same time, according to the speed with which said action occurs, the lever 52 and the spring 53 acquire a certain amount of kinetic energy $E_k$. The potential energy accumulated by the spring 53 will then be transferred suddenly to the second kinematic chain 60 and consequently to the mobile contact 10, once the mechanism exceeds the dead point, represented substantially by the alignment between the points 531, 641, and 631.

During said movement, the lever 51 for release of the energy, constituted, for example, by an arm fixed to the lever 52, describes a circular movement fixedly with the lever 52. On account of said movement, the pin 511 of the lever 51, intercepts, in the proximity of the dead point described above, the lever for recovery of energy 61, and by virtue of this operating contact transfers to the lever 61, via an impulse, at least part of the kinetic energy $E_k$ possessed at that moment by the lever 52 and by the mechanical members connected thereto. Said impulse sets in motion and accelerates the lever 61 and the mechanical parts operatively connected thereto. This mechanical action advantageously concurs, through the fork 64, with the action exerted in a parallel way by the springs 53 and 42. Once the dead point is exceeded, the spring 53 in fact contracts, suddenly yielding energy and drawing the contact-bearing shaft 41 in rotation via the connecting rod 63. Added to this action, at least for an initial instant, is the action of the spring 42, so that the entire mechanism is moved by a system of forces proportional to the sums of the energies stored in the springs 42 and 53 and to the kinetic energy possessed by the lever 52. In a device of a known type, opening occurs, instead, only by virtue of the energy accumulated in the springs 42 and 53.

Figure 3:
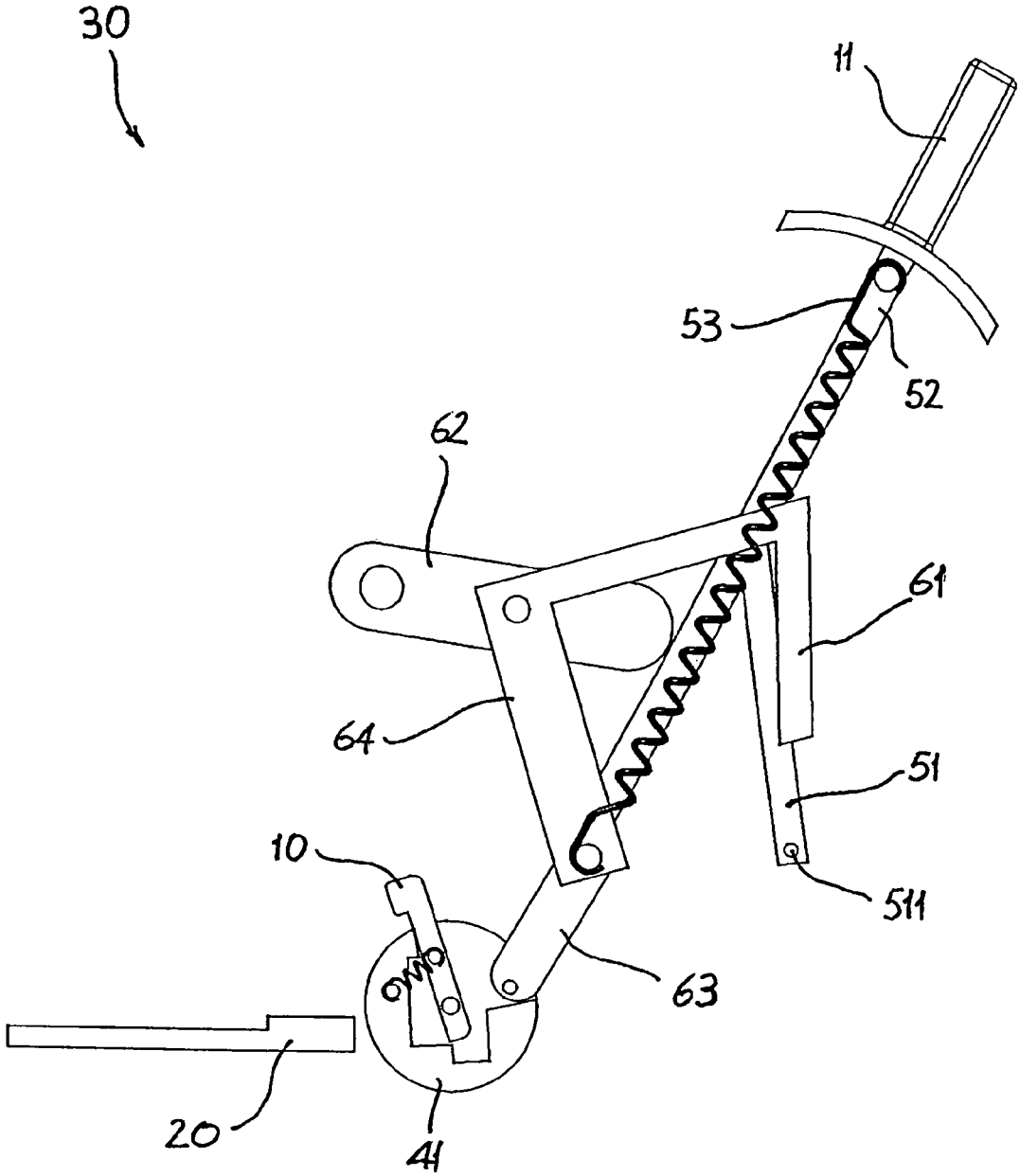
FIG. 3 is a schematic representation of the circuit-breaker of FIG. 1, illustrated in the circuit-opening position.

As illustrated in FIG. 3, where the circuit-breaker is represented in the opening position, at the end of the opening operation the pin 511, once it has completed its action of transfer of the energy impulse, is in a free position with respect to the lever 61 for recovery of the energy.

The circuit-breaker according to the invention also enables the positive-opening operation by means of the device illustrated previously.

Figure 4:
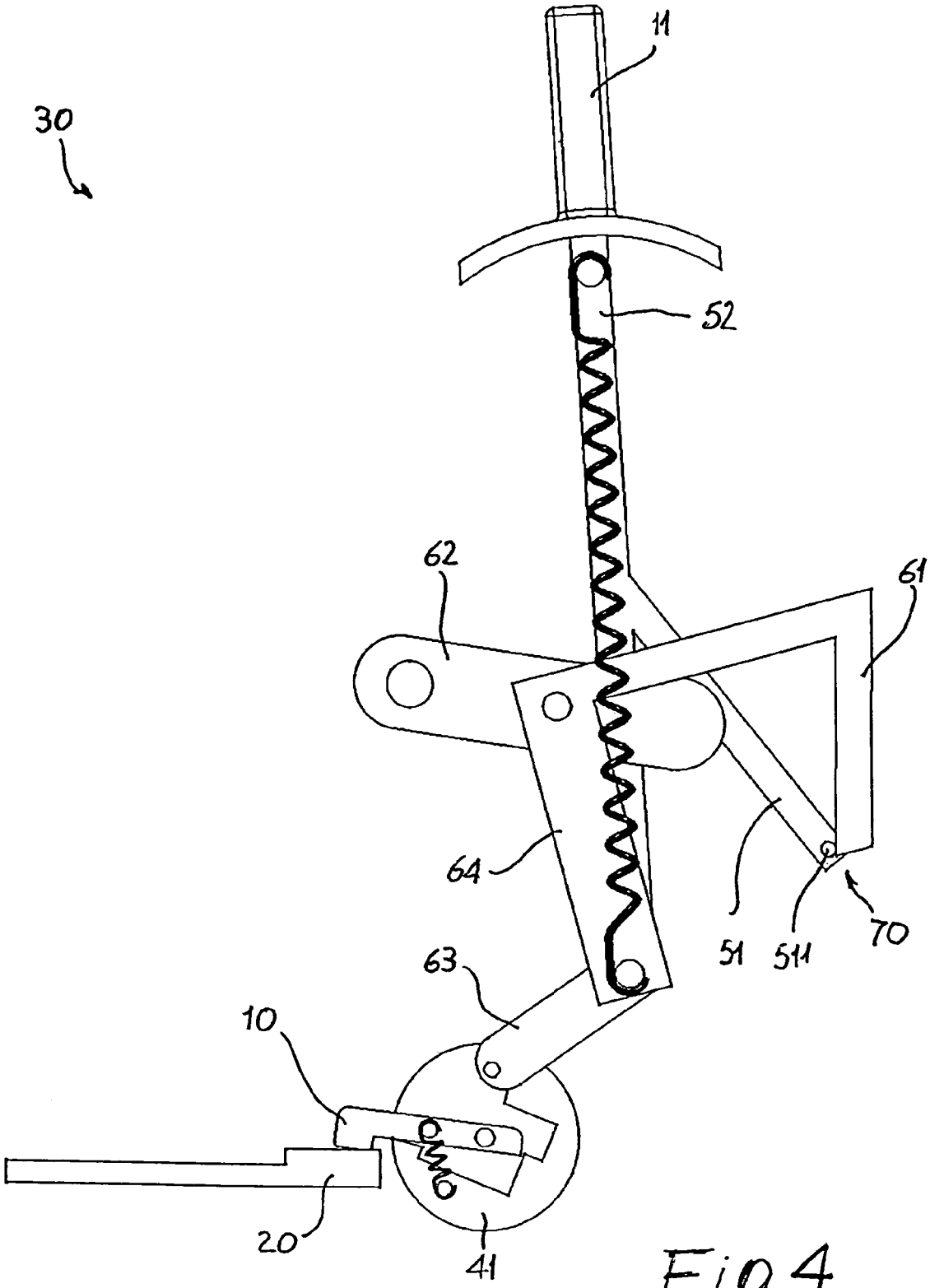
FIG. 4 is a schematic representation of the circuit-breaker of FIG. 1, illustrated in a position where the contacts are welded together.

With reference to FIG. 4, the circuit-breaker is illustrated in the closing position with the contacts welded together, an event that can arise in conditions of a short circuit of major proportions. When the contacts are welded together and an attempt is made to bring the lever 52 into the opening position, the latter moves initially in a regular way, with the lever 51 which intercepts, after a short travel, the lever 61, via for example the pin 511, drawing along with it the parts mechanically connected to said lever 61.

As a result of this contact, also the moving element 40 will start to rotate regularly, progressively unloading the spring 42. Since the contacts are welded together, this rotation to a certain point will be physically prevented by the mobile contacts themselves, by withholding the entire moving element in a stalled position. In this situation, any further movement of the lever 52 is found to be blocked. In fact, the levers 51 and 61 are provided with blocking devices 70, constituted, for example, by the pin 511 and by a surface of the lever 61 itself, which by interfering with one another keep the lever 51 still engaged with the lever 61. The travel of the lever 52 has thus been blocked, with the consequent impossibility of reaching the opening position, thus meeting the requirements of the corresponding current standards.

It is clear from what has been described that the low-voltage circuit-breaker and the corresponding positive-opening-operation device, according to the invention, achieves all of the pre-set purposes and objectives, presenting considerable advantages with respect to the known art both in terms of performance and in terms of production costs.

It has in fact been seen that, unlike circuit-breakers of a known type, the circuit-breaker according to the invention enables use of also at least part of the kinetic energy transmitted by the actuating device, thus enabling acceleration of the opening operation and consequently lengthening of the useful life of the circuit-breaker and improvement of its performance in the circuit-opening phase.

In addition, in the circuit-breaker according to the invention, the devices for acceleration of the positive-opening operation are integrated in a single mechanism, with consequent saving in terms of number of components and hence of costs.

The circuit-breaker thus devised may undergo numerous modifications and variations, all falling within the scope of the inventive idea. Furthermore, all the items may be replaced by other technically equivalent elements. In practice, the materials, as well as the dimensions, may be any whatsoever according to the requirements and the state of the art.

We claim:

1. A low-voltage circuit-breaker comprising at least one mobile contact (10), which can be coupled to/uncoupled from a corresponding fixed contact (20) and a positive-opening-operation device (30), said positive-opening-operation device (30) comprising: a moving element (40) associated to the mobile contact (10); a first kinematic chain (50) operatively associated to said mobile contact (10) and to an actuating device (11); and a second kinematic chain (60) associated to said moving element (40) and to said first kinematic chain (50), a first lever (51) being associated to the first kinematic chain (50) and a second lever (61) being associated to the second kinematic chain (60), said first and second levers (51, 61) interacting with one another during the opening operation and being equipped with blocking devices (70) in the event of welding of the contacts (10, 20) together.

2. The circuit-breaker according to claim 1, wherein said positive-opening-operation device (30) comprises a first spring (42) associated to said moving element (40) and a second spring (53) associated to said first and second kinematic chains (50, 60).

3. The circuit-breaker according to claim 2, wherein an opening operation of the contacts (10, 20) as a result of a force applied on said actuating device (11) comprises: a first phase, in which the first kinematic chain (50) moves as a result of said force applied on said actuating device (11), storing energy in said second spring (53), the second kinematic chain (60) remaining substantially stationary; and a second phase, in which the second kinematic chain (60) moves as a result of the release of energy stored in said first spring and/or second spring (53) and/or as a result of the interaction between said first and second levers (51, 61).

4. The circuit-breaker according to claim 3, wherein in said second phase and in the event of welding of the contacts (10, 20) together, the movement in opening of said first kinematic chain is blocked by said blocking devices (70) of said first and second levers (51, 61).

5. The circuit-breaker according to claim 1, wherein said first lever (51) transfers to said second lever (61) at least part of the kinetic energy E.sub.k possessed by the first kinematic chain (50) in the opening phase, and in that said second lever (61) transfers to said moving element (40), through the second kinematic chain (60), at least part of the kinetic energy E.sub.k received from said kinematic chain (50).

6. The circuit-breaker according to claim 1, wherein said moving element comprises: a contact-bearing shaft (41), which rotates about its own axis (100) and from which there projects at least one mobile contact (10); and at least one first spring (42) that acts on said contact-bearing shaft (41) and on said mobile contact (10).

7. The circuit-breaker according to claim 6, wherein said first kinematic chain (50) comprises: a first hinge (200); a third control lever (52), which is pivoted on said first binge and is operatively connected to said actuating device (11); and a second spring (53), constrained to said third control lever (52) and operatively connected to said second kinematic chain, the first lever (51) being fixed to said third control lever (52).

8. The circuit-breaker according to claim 7, wherein said second kinematic chain (60) comprises: a second binge (300); a first crank (62); a first connecting rod (63); end a first fork (64), the first crank (62) being pivoted on said second hinge (300), the first connecting rod (63) having a first end pivoted on said contact-bearing shaft (41), said second spring (53) and a first end of said first fork (64) being operatively connected to said first connecting rod (63), a point of said first fork (64) being pivoted on said first crank (62), and the second lever (61) projecting from said first fork (64).

9. The circuit-breaker according to claim 8, wherein an opening operation of the contacts (10, 20) as a result of a force applied on said actuating device (11) comprises: a first phase, in which said third lever (52) rotates about said hinge (200), storing energy in said second spring (53), the second kinematic pair (60) remaining substantially stationary; and a second phase, in which said third lever (52) continues to rotate about said hinge (200), transferring, via an interaction between said first and second levers (51,61), at least part of the kinetic energy Ek to said second kinematic chain (60).

10. The circuit-breaker according to claim 9, wherein said second phase comprises: a first step, in which the contact-bearing shaft (41) rotates about its own axis (100) as a result of the action of said second spring (53) through the first connecting rod (63), as a result of the action of said first spring (42) and as a result of the action of the first lever (51) through the second lever (61) and the first fork (64), the mobile contact (10) remaining substantially stationary; and a second step, in which the contact-bearing shaft (41) continues to rotate about its own axis (100) drawing along with it said mobile contact (10).

11. The circuit-breaker according claim 10, wherein, in the event of welding of the contacts together, at the end of said first step of said second phase, the rotation of the third lever (52) about said first hinge (200) is prevented by said blocking devices for blocking said first and second levers (51, 61).

12. The circuit-breaker according to claim 1, wherein said first kinematic chain (50) comprises: a first hinge (200); a third control lever (52), which is pivoted on said first hinge and is operatively connected to said actuating device (11); and a second spring (53), constrained to said third control lever (52) and operatively connected to said second kinematic chain, the first lever (51) being fixed to said third control lever (52).

13. The circuit-breaker according to claim 1, wherein said second kinematic chain (60) comprises: a second hinge (300); a first crank (62); a first connecting rod (63); and a first fork (64), the first crank (62) being pivoted on said second hinge (300), the first connecting rod (63) having a first end pivoted on said contact-bearing shaft (41), said second spring (53) and a first end of said first fork (64) being operatively connected to said first connecting rod (63), a point of said first fork (64) being pivoted on said first crank (62), and the second lever (61) projecting from said first fork (64).

14. The circuit-breaker according to claim 1, wherein said circuit-breaker comprises for each pole a double-interruption device.

15. A low-voltage circuit-breaker comprising an integrated positive-opening-operation mechanism, which operatively connects an actuating device to a mobile contact that can be coupled to/uncoupled from a corresponding fixed contact, said positive-opening mechanism comprising;

first means for storing an amount of potential energy and converting said stored potential energy into kinetic energy that is in turn transmitted to said mobile contact during the movement of said actuating device; and second means for directly transferring to the mobile contact at least a part of the kinetic energy that is used to actuate said actuating device.

* * * * *